US005256839A

United States Patent [19]

Gallagher

[11] Patent Number: 5,256,839

[45] Date of Patent: Oct. 26, 1993

[54] TILT SWITCH RESPONSIVE TO ACCELERATION OR DECELERATION

[76] Inventor: Shawn Gallagher, 375 Glendening Rd., Orange Park, Fla. 32073

[21] Appl. No.: 847,750

[22] Filed: Mar. 5, 1992

[51] Int. Cl.[5] ..... H01H 35/14

[52] U.S. Cl. ..... 200/61.52; 335/205; 335/206

[58] Field of Search ..... 200/61.45 R-61.53; 335/205-207

[56] References Cited

U.S. PATENT DOCUMENTS

| | | | |
|---|---|---|---|
| 3,601,729 | 8/1971 | Hierta | 335/205 |
| 3,737,599 | 6/1973 | Zuvela | 200/61.45 R |
| 3,795,780 | 3/1974 | Lawrie | 200/61.45 R |
| 4,518,835 | 5/1985 | Grossar | 200/61.45 M |
| 4,639,563 | 1/1987 | Gunther | 200/61.45 M |
| 4,705,922 | 11/1987 | Seeger et al. | 200/61.45 M |
| 4,820,888 | 4/1989 | Shields | 200/61.45 M |
| 4,900,880 | 2/1990 | Breed | 200/61.45 M |
| 4,965,416 | 10/1990 | Bachmann | 200/61.45 M |
| 5,010,216 | 4/1991 | Sewell et al. | 200/61.45 M |
| 5,028,750 | 7/1991 | Spies et al. | 200/61.45 M |
| 5,155,460 | 10/1992 | Huckins et al. | 335/205 |

*Primary Examiner*—J. R. Scott

[57] ABSTRACT

An economical and accurate tilt switch, which incorporates a reed switch, a small disc shaped magnet, and an enclosed track in which the magnet is allowed to roll just enough to affect the contacts of the reed switch. Invented to replace the well known mercury switch, but avoid the environmental hazards of mercury poisoning. The present tilt switch can be adapted into many different designs providing a wider range of switching characteristics than that of the old mercury switch.

4 Claims, 2 Drawing Sheets

TILT SWITCH RESPONSIVE TO ACCELERATION OR DECELERATION

BACKGROUND-FIELD OF INVENTION

The invention relates to electrical position sensitive switching devices, specifically, such devices used to open or close an electrical circuit upon tilting, accelerating or decelerating the device.

DESCRIPTION OF PRIOR ART

Electrical switches which are able to open or close an electrical circuit in response to a change in position are needed quite frequently in the every day world. In almost every instance, the well known mercury switch is required. The mercury switch is small, economic, reliable, accurate, and easily altered into many different designs for custom switching requirements. Unfortunately, the toxic mercury contents have proven to be an environmental hazard. Mercury poisoning has been found to be such an irreversible problem, some countries have banned the import of products containing mercury.

Devices created in an attempt to replace the mercury switch are numerous. Tilt switches employing the use of ball bearings, pendulums, and electrolytic fluids have come close to the switching characteristics of the mercury switch, but because the switches require the use of precious metals or complex mechanical workings, they prove to be much more expensive. Once such device, claiming to assume the role of the mercury switch is described in U.S. Pat. No. 4,363,021 , issued Apr. 11, 1989, titled "Tilt switch replacing mercury switches" by Larry E. Shields. Upon reviewing the patent of the prior art, it will be found that although the device is inexpensive, it is also inaccurate and somewhat large.

The prior art incorporates a reed switch and a plug shaped magnet, all in a cylindrical housing. Upon tilting the switch assembly, the magnet, after overcoming the resistance of friction, slides down the bore into the appropriate position to close the contacts of the normally open reed switch Tilting the switch in the reverse direction, the magnet slides back down the bore only after its mass can overcome both the slight magnetic attraction between it and the reed switch and the resistance caused by friction. Although the prior art attempts to replace the well known mercury switch, the prior art is restricted in use because of several shortcomings and can only be used in very limited situations.

One shortcoming of the prior art is the amount of tilt, in degrees, incurred between the point of closing the contacts and the point of opening the contacts, which is stated as being 45 degrees or less. This characteristic restricts the use of the prior switch to operations where large arcs of tilt are to be observed. This eliminates the prior switch from uses most common to mercury switches, such as in thermostats, tampering alarms, medical devices observing the movements of body parts, devices used by handicapped individuals to initiate certain motorized assistant devices, or the many other operations where a much smaller motion in tilting must be observed.

Another shortcoming of the prior art is due to the unpredictable sliding action required of the magnet. This causes inconsistent switching characteristics and poor repeatability. For example, assume the prior art was required to operate under conditions subject to vibration, the prior art would then be required to tilt at less of an angle to alter the state of the reed switch. These high tolerances would further limit the use of the prior art.

In summarizing the short comings of the prior art, consider the following comparison: An average mercury switch rotates no more than 5 degrees between opening and closing a circuit, plus or minus 2 degrees. The prior art rotates 33.75 degrees between opening and closing a circuit, plus or minus 11.25 degrees.

SUMMARY

It is an object of the present invention to provide a device capable of opening and closing an electrical circuit, in response to tilting, relative to a level plane. The device utilizes a small disc shaped magnet and a reed switch. When the device is tilted, the magnet rolls along an enclosed track to the appropriate position to open or close the contacts of the reed switch.

Another object of the present invention is to eliminate the need for the well known mercury switch, thus eliminating the environmental hazards of mercury poisoning by providing a practical and accurate tilt switch.

Yet another object of the present invention is to provide a linear motion responsive device capable of opening or closing an electrical circuit upon acceleration or deceleration of the device.

DETAILED DESCRIPTION OF THE INVENTION

Figure 1:
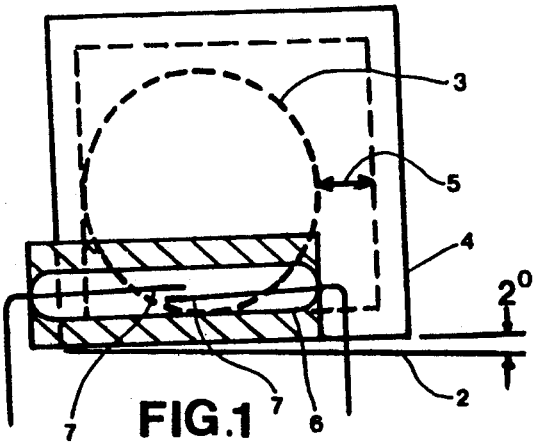
FIG. 1 is a side elevation view of the switch assembly in an open circuit position, relative to a level plane.
Figure 2:
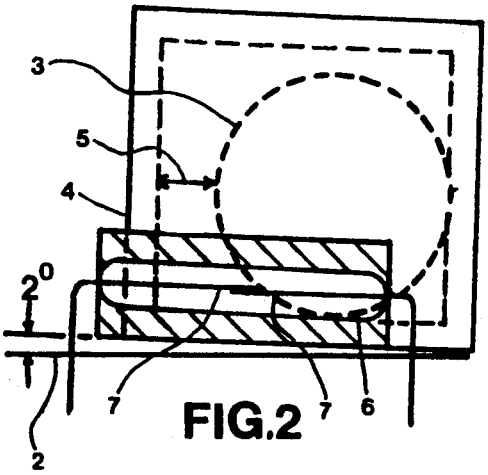
FIG. 2 is a side elevation view of the switch assembly in a closed circuit position, relative to a level plane.

FIG. 1 shows the preferred embodiment of the present invention in an open circuit position. The switch assembly will maintain in this open state at any angle greater than or equal to the degree of tilt above a level plane 2. As the switch assembly is rotated clockwise from the position in FIG. 1 it will maintain an open circuit state until reaching the position in FIG. 2. At this point, the switch assembly assumes a closed circuit state and will maintain this closed state at any degree of tilt greater or equal to two degrees below a level plane 2. Conversely, as the switch assembly in FIG. 2 is rotated counterclockwise, it will maintain a closed circuit until reaching the point illustrated in FIG. 1 which is once again two degrees above a level plane 2.

Figure 3:
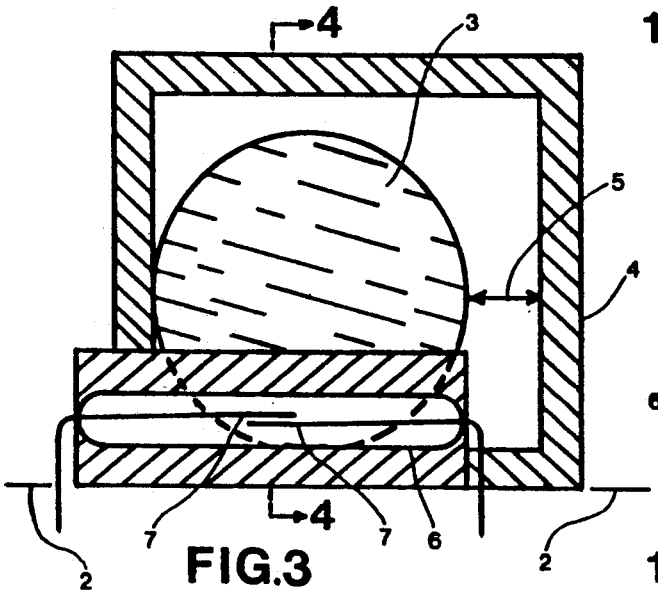
FIG. 3 is a multi level section view of the switch assembly. (circuit open position)
Figure 4:
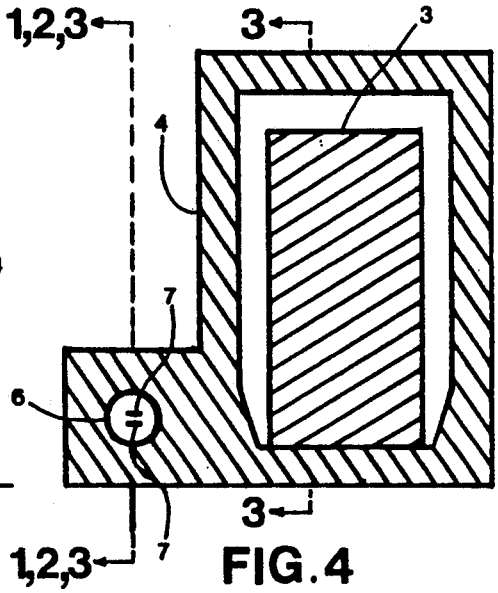
FIG. 4 is an end elevation section view of the switch assembly.
Figure 5:
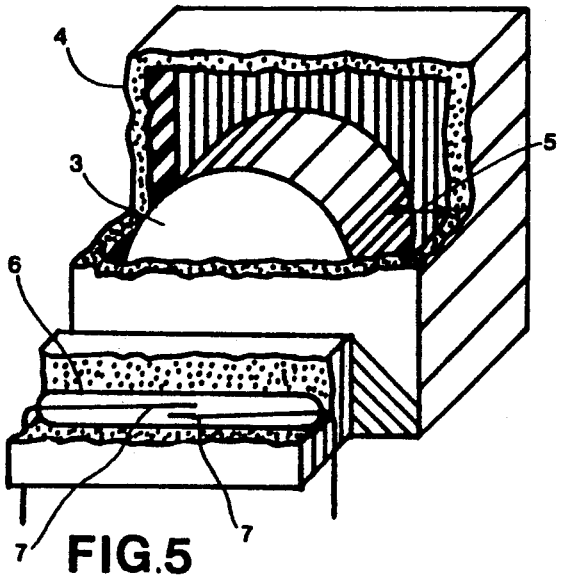
FIG. 5 is an oblique, cutaway drawing of the switch assembly. (circuit open position)

The linear motion sensitive characteristic of the present invention can best be illustrated by referring to FIG. 3. With the switch assembly resting parallel to a level plane 2 and then acted upon by a force which accelerates the switch assembly to the left, a magnet 3 rolls to the right end of enclosed track 4 which is the position that causes the contacts 7 of a reed switch 6 to close. Conversely, as the switch assembly decelerates from this direction, magnet 3 returns to the right end of enclosed track 4 therefore allowing contacts 7 of reed switch 6 to open.

The mechanics involved in altering the state of the tilt switch can best be explained by referring to all FIGS. 1,2,3,4,5. The components of the switch assembly consist of a common disc shaped magnet 3, north and south poles corresponding to either flat side, confined in a small enclosed track 4 in which magnet 3 is allowed to travel 5 a short distance by rolling. Mounted a short distance away from enclosed track 4 is a well known reed switch 6, protected by the same suitable durable plastic enclosed track 4 is made of. In FIG. 1, enclosed track 4 being tilted above level plane 2, gravity acts on magnet 3 holding it in a position where the flow of the magnetic field is inappropriate to cause contacts 7 of reed switch 6 to become magnetically attracted to each other. Upon tilting the switch assembly to the position in FIG. 2, gravity acts on magnet 3 causing it to roll the short distance to the other end of enclosed track 4. In this position, the magnetic flux is such that contacts 7 of reed switch 6 become flux carriers and therefore become attracted to each other making contact, thus, allowing an electrical current to pass through.

It may be obvious to those skilled in the art, that this use of reed switch 6 and magnet 3 is unusual. Usually the reed switch 6 and magnet 3 are used in a proximity-sensitive relationship, where changing the distance between the two is what alters contacts 7 of reed switch 6.

An individual skilled in the art could create a tilt switch by incorporating a rolling magnet and reed switch in their usual proximity-responsive relationship. Although the resulting tilt switch would be more sensitive and accurate than the prior art discussed earlier, it would be larger and less sensitive than the present invention.

Since it is clearly seen that there is no change in the distance between magnet 3 and reed switch 6 used in the present invention, one may wonder how or why contacts 7 are being opened or closed. The present invention taps the flux-direction sensitive characteristic of reed switch 6 which is currently not well known. It has been found through extensive research that reed switch 6 only closes its contacts when aligned relatively parallel to the flow of a magnetic field. This flux-direction sensitive characteristic of reed switch 6 is the working phenomena exploited by this novel invention.

The benefits brought forth by tapping this characteristic are significant. Reed switch 6 is now able to be positioned next to rolling magnet 3 permitting narrow width. Also, there is no magnetic pull to be overcome by magnet 3. Although there is a slight magnetic attraction between reed switch 6 and magnet 3, it is 90 degrees to the direction of travel 5, and at a constant force. Furthermore, by positioning reed switch 6 as low as possible, and at the maximum distance away from magnet 3, the attraction is minimal and the direction of this attraction is even less influential, allowing magnet 3 to roll freely, therefore permitting sensitivity and accuracy. Finally, the small amount of travel 5 required of magnet 3 to affect reed switch 6 enables the entire switch assembly to be short in length. In summarizing, by employing the use of reed switch 6 and magnet 3 in this novel way, a practical tilt switch which is small in size, sensitive, and accurate is provided.

In staying with the present invention's principle method of operation, it should be shown obvious to those skilled in the art that many different variations of the invention are possible. Just as there are many different mercury switches available for different needs, the present invention is just as adaptable to provide specific switching characteristics, if not more so.

By filling enclosed track 4 with a viscus fluid not shown, a dampening affect could be provided for a vibration proof tilt switch. By altering the shape of enclosed track 4 as shown in FIGS. 6–9, many different embodiments of the invention are possible for custom switching requirements.

Figure 6:
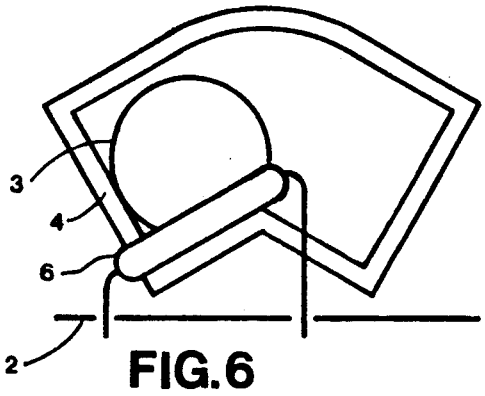
FIG. 6 is a diagram of an embodiment of the present invention relative to a level plane.

FIG. 6 is a diagram of an embodiment where enclosed track 4 has been curved. The middle being higher than the ends. This modification would require the switch assembly to rotate clockwise a greater number of degrees to assume an open state, and a greater number of degrees of counterclockwise rotation to assume a closed state. The exact points at which these circuits are altered are still very consistent.

Figure 7:
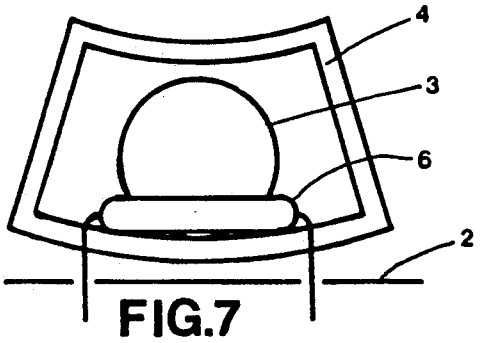
FIG. 7 is a diagram of an embodiment of the present invention relative to a level plane.

FIG. 7 is a diagram of an embodiment of the present invention where enclosed track 4 has been lengthened as well as curved up at both ends. Also, reed switch 6 has been oriented alongside the middle of enclosed track 4. This embodiment provides a normally open tilt switch able to close a circuit upon tilting only 1 degree in either of two directions. The amount of tilt, needed to alter the contacts of reed switch 6 would depend on the radius of the curve in enclosed track 4. Although somewhat larger, this embodiment is able to take the place of two such switch assemblies referred to earlier as the preferred embodiment.

Figure 8:
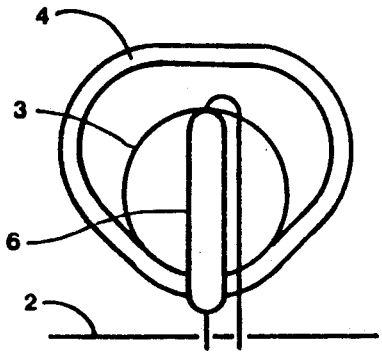
FIG. 8 is a diagram of an embodiment of the present invention relative to a level plane.

FIG. 8 is a diagram of an embodiment where confined track 4 has been angled up 45 degrees from level plane 2 at both ends. The size of enclosed track 4 is such that it will not permit magnet 3 to roll out of the magnetically affective range of reed switch 6. Reed switch 6 is positioned vertically in the middle, alongside enclosed trace 4.

This embodiment provides a normally open tilt switch assembly, able to close a circuit upon tilting past 45 degrees in either of two directions. It would be obvious to one skilled in the art that altering the angle at which enclosed track 4 is slanted upward at both ends would alter the amount of tilt required of the switch assembly to close a circuit.

Figure 9:
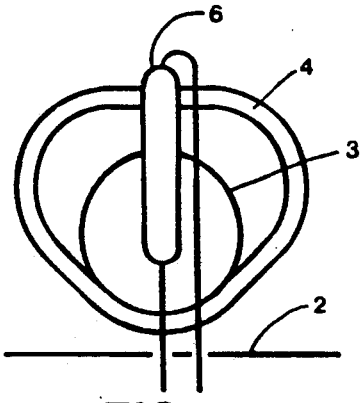
FIG. 9 is a diagram of an embodiment of the present invention relative to a level plane.
Figure 11:
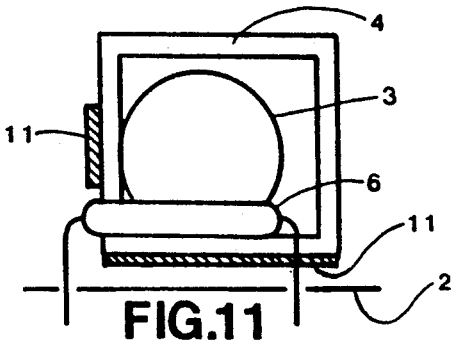
FIG. 11 is a diagram of an embodiment of the present invention with the addition of ferrous metal plates.

FIG. 9 is a diagram of an embodiment similar to FIG. 11 but with the position of reed switch 6 slightly higher.

This small modification enables the embodiment to provide a normally closed tilt switch, able to open a circuit upon tilting more than 45 degrees in either of two directions. This being the opposite reaction to tilting than the embodiment diagramed in FIG. 8.

Figure 10:
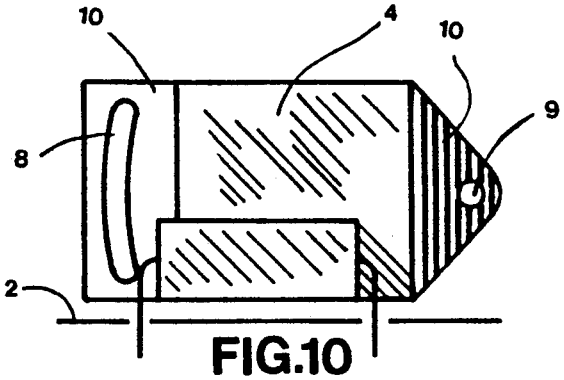
FIG. 10 is a side elevation view of an embodiment of the present invention with additional mounting ability.

FIG. 10 shows an embodiment of the present invention with the added ability to be mounted to a surface, using suitable fasteners such as screws. Vertically-elongated mounting-hole 8 enables the switch assembly to be accurately adjusted, pivoting on the fastener in pivot-hole 9. Mounting members 10 can be employed on any embodiment of the present invention where space is not limited.

FIG. 11 is a diagram of an embodiment of the present invention with the addition of ferrous metal plates Attached about enclosed track 4, using a suitable adhesive, plates 11 can alter the response of magnet 3 upon tilting of the switch assembly. Depending on the location and thickness of plate 11, a desired switching characteristic ca be provided without altering the shape or size of the switch assembly.

Consider for example, the different performance of the switch assembly shown in FIG. 11 compared to that of the preferred embodiment shown in FIGS. 1-5. Because of the magnetic attraction between plate 11 and magnet 3, the switch assembly in FIG. 11 must tilt clockwise more degrees before magnet 3 will roll to the other end of enclosed track 4 and cause contacts 7 of reed switch 6 to close. The amount of clockwise tilt required of the switch assembly before closing contacts 7 would depend on the thickness of plate 11. The weight and strength of magnet 3 could also be altered to produce a desired switching characteristic.

Figure 12:
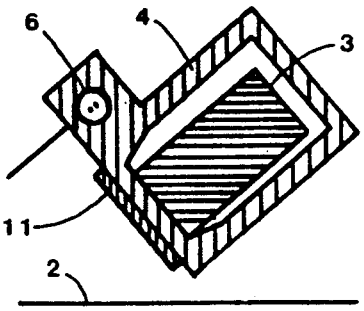
FIG. 12 is an end section view of the switch assembly in FIG. 11 angled to the side relative to a level plane.

FIG. 12 shows the use of a ferrous metal plate 11 attached along the bottom of enclosed track 4. This small modification permits the use of the switch assembly where uneven or tipped conditions exists. Because of the constant magnetic attraction between magnet 3 and plate 11, the switch assembly will maintain excellent switching characteristic in all conditions, from slightly tipped to totally inverted up-side-down.

It will become obvious, to those skilled in the art, that many other embodiments and variations of the present invention are possible without departing from the spirit or scope of the present invention. Imagine the use of more than one reed switch in a single switch assembly, or a round enclosed track with a plurality of reed switches able to alter a number of different electrical circuits. The descriptions and illustrations are by way of examples only and not to be taken as limiting the invention in any way. The present invention is limited only by the scope of the following claims:

What I claim is:

1. In a device capable of altering an electrical circuit in response to rotational and linear movement, comprising a housing having a cavity in which a substantially cylindrical shaped magnet is allowed to roll within a single plane in response to gravity of inertia, the cylindrical magnet having north and south poles aligned axially whereby said north and south poles are oriented on opposite end of said cylindrical magnet, a reed switch immovably secured within said housing in a position which is substantially longitudinally parallel to said single plane of said cylindrical magnet and substantially perpendicular to the axial direction of magnetism of said cylindrical magnet, said reed switch having a least two reed contacts, said cylindrical magnet and said reed switch positioned relative to each other inside said housing such that upon tilting or accelerating said housing in one direction causes the cylindrical magnet to move to one of two positions, said one position of said cylindrical magnet is such that the magnetic field is sufficiently aligned to cause said reeds of said reed switch to become flux carriers thus producing attractive polarities between said reeds causing contact to be made by said reeds, thus allowing an electric current to pass, tilting or accelerating said housing in a reverse direction causes said cylindrical magnet to move to the other of said two positions, wherein said magnetic field from said cylindrical magnet is insufficiently aligned to cause said reeds of said reed switch to become attracted to each other, therefore not making contact, thus not enabling said electrical current to pass.

2. The device in claim 1 wherein said cavity of said housing is filled with dampening fluid, whereby said response of said cylindrical magnet due to said gravity or said inertia, is slowed.

3. The device in claim 1 wherein ferrous metal plates are attached to said housing around the area forming said cavity in which said cylindrical magnet rolls within said single plane whereby said response of said cylindrical magnet due to said gravity or said inertia is altered by the magnetic attraction between said ferrous metal plates and said cylindrical magnet.

4. The device in claim 1 wherein there is a plurality of reed switches.

* * * * *